US008973658B2

(12) United States Patent
Macadam et al.

(10) Patent No.: US 8,973,658 B2
(45) Date of Patent: Mar. 10, 2015

(54) HEAT RECOVERY METHOD FOR WELLPAD SAGD STEAM GENERATION

(75) Inventors: Scott Macadam, Calgary (CA); James P. Seaba, Bartlesville, OK (US); David C. LaMont, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 323 days.

(21) Appl. No.: 13/411,266

(22) Filed: Mar. 2, 2012

(65) Prior Publication Data

US 2013/0068458 A1 Mar. 21, 2013

Related U.S. Application Data

(60) Provisional application No. 61/449,437, filed on Mar. 4, 2011.

(51) Int. Cl.

| | |
|---|---|
| ***E21B 43/24*** | (2006.01) |
| ***E21B 43/34*** | (2006.01) |
| ***F22D 1/16*** | (2006.01) |
| ***E21B 43/40*** | (2006.01) |

(52) U.S. Cl.

CPC ..... *E21B 43/2406* (2013.01); *F22D 1/16* (2013.01); *E21B 43/40* (2013.01)

USPC ..... 166/272.3; 166/57; 166/66; 166/75.12

(58) Field of Classification Search

USPC ..... 166/369, 75.12, 266, 267, 303, 57

See application file for complete search history.

(56) References Cited

U.S. PATENT DOCUMENTS

| | | | | |
|---|---|---|---|---|
| 3,353,593 | A * | 11/1967 | Boberg | 166/252.1 |
| 3,442,333 | A | 5/1969 | Meldau | |
| 4,398,603 | A * | 8/1983 | Rodwell | 166/267 |
| 4,418,651 | A * | 12/1983 | Wyatt | 122/31.1 |
| 4,498,542 | A * | 2/1985 | Eisenhawer et al. | 166/303 |
| 4,518,505 | A * | 5/1985 | Lim et al. | 210/712 |
| 4,969,520 | A * | 11/1990 | Jan et al. | 166/266 |
| 5,979,549 | A * | 11/1999 | Meeks | 166/57 |
| 6,357,526 | B1 * | 3/2002 | Abdel-Halim et al. | 166/272.3 |
| 6,536,523 | B1 | 3/2003 | Kresnyak et al. | |
| 6,606,862 | B1 | 8/2003 | Wallace et al. | |
| 6,988,549 | B1 * | 1/2006 | Babcock | 166/267 |
| 7,128,156 | B2 * | 10/2006 | McClung, III | 166/302 |
| 7,591,309 | B2 * | 9/2009 | Minnich et al. | 166/266 |
| 7,694,736 | B2 * | 4/2010 | Betzer Tsilevich | 166/272.3 |
| 7,699,104 | B2 * | 4/2010 | Tsilevich | 166/272.3 |

(Continued)

FOREIGN PATENT DOCUMENTS

| | | |
|---|---|---|
| JP | 2003277015 | 10/2003 |
| WO | 0062592 | 10/2000 |
| WO | 03021147 | 3/2003 |

OTHER PUBLICATIONS

Patent Cooperation Treaty International Search Report (PCT Article 18 and Rules 43 and 44) PCT/US2012/027560, Filing Date—Feb. 3, 2012, Priority Date—Apr. 3, 2011.

*Primary Examiner* — Jennifer H Gay

(74) *Attorney, Agent, or Firm* — ConocoPhillips Company

(57) ABSTRACT

A method of recovering heat from hot produced fluids at SAGD facilities is described that utilizes wellpad steam generation such as Direct Steam Generators (DSG). Heated fluids produced by SAGD are used to preheat the water that is used to make steam for SAGD. Feedwater is conveniently preheated at the wellpads by the produced fluids, emulsions, and/or gases before feeding to the DSGs.

4 Claims, 4 Drawing Sheets

(56) References Cited

U.S. PATENT DOCUMENTS

| | | | | |
|---|---|---|---|---|
| 7,931,083 | B2 * | 4/2011 | Betzer Tsilevich | 166/272.3 |
| 8,414,666 | B2 * | 4/2013 | Palamara et al. | 48/61 |
| 2005/0205260 | A1 * | 9/2005 | McClung, III | 166/302 |
| 2008/0078552 | A1 | 4/2008 | Donnelly et al. | |
| 2008/0110630 | A1 * | 5/2008 | Minnich et al. | 166/303 |
| 2008/0289821 | A1 * | 11/2008 | Betzer Tsilevich | 166/272.3 |
| 2008/0289822 | A1 * | 11/2008 | Betzer Tsilevich | 166/272.3 |
| 2009/0030254 | A1 | 1/2009 | Spicer | |
| 2010/0193188 | A1 * | 8/2010 | Betzer Tsilevich | 166/272.3 |
| 2010/0200231 | A1 | 8/2010 | Minnich | |
| 2010/0276983 | A1 * | 11/2010 | Dunn et al. | 299/7 |
| 2011/0017449 | A1 * | 1/2011 | Berruti | 166/272.3 |
| 2011/0017455 | A1 * | 1/2011 | Duong | 166/303 |
| 2011/0139451 | A1 * | 6/2011 | McKeen et al. | 166/267 |
| 2012/0193093 | A1 * | 8/2012 | James | 166/267 |
| 2012/0294783 | A1 * | 11/2012 | Palamara et al. | 422/625 |
| 2013/0068458 | A1 * | 3/2013 | Macadam et al. | 166/272.3 |
| 2013/0112394 | A1 * | 5/2013 | O'Donnell et al. | 166/57 |
| 2013/0161009 | A1 * | 6/2013 | Price et al. | 166/303 |

* cited by examiner

HEAT RECOVERY METHOD FOR WELLPAD SAGD STEAM GENERATION

CROSS-REFERENCE TO RELATED APPLICATIONS

This application is a non-provisional application which claims the benefit of and priority to U.S. Provisional Application Ser. No. 61/449,437 filed Mar. 4, 2012, entitled "Heat Recovery Method for Wellpad SAGD Steam Generation," which is hereby incorporated by reference in its entirety.

FEDERALLY SPONSORED RESEARCH STATEMENT

Not applicable.

FIELD OF THE INVENTION

The invention relates to a system for improving heat recovery in steam assisted gravity drainage operation.

BACKGROUND OF THE INVENTION

Steam Assisted Gravity Drainage (SAGD) is an enhanced oil recovery technology for producing heavy crude oil and bitumen. The gravity drainage idea was originally conceived by Dr. Roger Butler around 1969, and field tested in 1980 at Cold Lake, Alberta, which featured one of the first horizontal wells in the industry with vertical injectors. The latter were established to be inefficient, resulting in the first test of twin (horizontal) well SAGD in the Athabasca Oil Sands, which proved the feasibility of the concept, briefly achieving positive cash flow in 1992 at a production rate of about 2000 bbl/day from 3 well pairs.

In the SAGD process today, two parallel horizontal oil wells are drilled in the formation, one about 4 to 6 meters above the other. Steam in injected via the upper well, possibly mixed with solvents, and the lower well collects the heated crude oil or bitumen that flows out of the formation, along with any water from the condensation of injected steam. The basis of the process is that the injected steam forms a "steam chamber" that grows vertically and horizontally in the formation. The heat from the steam reduces the viscosity of the heavy crude oil or bitumen, which allows it to flow by gravity down into the lower wellbore. The steam and gases rise because of their low density compared to the heavy crude oil below, ensuring that steam is not produced at the lower production well. The gases released, which include methane, carbon dioxide, and usually some hydrogen sulfide, tend to rise in the steam chamber, filling the void space left by the oil and, to a certain extent, forming an insulating heat blanket above the steam. Oil and water flow is by a countercurrent, gravity driven drainage into the lower well bore. The condensed water and crude oil or bitumen is recovered to the surface by pumps such as progressive cavity pumps that work well for moving high-viscosity fluids with suspended solids.

Operating the injection and production wells at approximately reservoir pressure eliminates the instability problems that plague all high-pressure steam processes and SAGD produces a smooth, even production that can be as high as 70% to 80% of oil in place in suitable reservoirs. The process is relatively insensitive to shale streaks and other vertical barriers to steam and fluid flow because, as the rock is heated, differential thermal expansion causes fractures in it, allowing steam and fluids to flow through. This allows recovery rates of 60% to 70% of oil in place, even in formations with many thin shale barriers.

Thermally, SAGD is twice as efficient as the older cyclic steam stimulation (CSS) process, and it results in far fewer wells being damaged by high pressure. Combined with the higher oil recovery rates achieved, this means that SAGD is much more economic than pressure-driven steam process where the reservoir is reasonably thick.

This technology is now being increasingly exploited due to increased oil prices. While traditional drilling methods were prevalent up until the 1990s, high crude prices of the 21st Century are encouraging more unconventional methods (such as SAGD) to extract crude oil. The Canadian oil sands have many SAGD projects in progress, since this region is home of one of the largest deposits of bitumen in the world.

As in all thermal recovery processes, the cost of steam generation is a major part of the cost of oil production. Historically, natural gas has been used as a fuel for Canadian oil sands projects, due to the presence of large stranded gas reserves in the oil sands area. However, with the building of natural gas pipelines to outside markets in Canada and the United States, the price of gas has become an important consideration. The fact that natural gas production in Canada has peaked and is now declining is also a problem. Other sources of generating heat are under consideration, notably gasification of the heavy fractions of the produced bitumen to produce syngas, using the nearby (and massive) deposits of coal, or even building nuclear reactors to produce the heat.

In addition to the operating costs of generating steam, a source of large amounts of fresh and/or brackish water and large water re-cycling facilities are required in order to create the steam for the SAGD process. Thus, lack of water and competing demands for water may also be a constraint on development of SAGD use. Further, since SAGD relies upon gravity drainage, the reservoirs must be comparatively thick and homogeneous, and thus SAGD is not suitable for all heavy-oil production areas.

Alternative enhanced oil recovery mechanisms include VAPEX (for Vapor Extraction), Electro-Thermal Dynamic Stripping Process (ET-DSP), and ISC (for In Situ Combustion). VAPEX uses solvents instead of steam to displace oil and reduce its viscosity. ET-DSP is a patented process that uses electricity to heat oil sands deposits to mobilize bitumen allowing production using simple vertical wells. ISC uses oxygen to generate heat (by burning some amount of the oil reserve) that diminishes oil viscosity and also produces carbon dioxide. One ISC approach is called THAI for Toe to Heel Air Injection.

In most steam assisted gravity drainage (SAGD) operations, the SAGD steam is generated at a central processing facility (CPF) and conveyed to the wellpads, where it is injected into the SAGD reservoirs. An alternate approach is to locate the steam generating devices at the wellpads and convey the required water, fuel, and oxidant to the steam generators from the CPF. One example of a wellpad steam generator is the Direct Steam Generator (DSG) concept, where fuel is burned with oxygen in the presence of water to produce steam/$CO_2$ for SAGD.

The performance of SAGD wellpad steam generators such as Direct Steam Generators (DSGs) can be enhanced by preheating the feedwater with waste heat from SAGD produced fluids. The conventional approach is to perform the feedwater preheating at the central processing facility. However, heat losses from the hot streams conveyed between the pads and the CPF will reduce the maximum attainable preheat temperature. Ideally a wellpad steam generator can solve this temperature drop problem, but no wellpad steam generator such as DSGs have been commercially deployed yet.

Direct Steam Generators are newly developed devices that can generate steam on the wellpad rather than at the central processing facility. The small footprint of a DSG may be especially favorable in view of the limited space at the wellpad. By implementing these on-site DSGs, energies could be conserved greatly due to the reduction of heat losses during steam transmission. However, further improvements can still be obtained.

What is needed in the art are improved SAGD methods that further reduce the cost and improve the efficiency of SAGD and related methods of oil recovery.

SUMMARY OF THE INVENTION

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The following abbreviations are used herein:

| | |
|---|---|
| BBL | Barrels |
| CAPEX | capital expenses |
| CPF | Central processing facility |
| DSG | Direct steam generator |
| OPEX | operational expenses |
| SAGD | Steam assisted gravity drainage |
| LHV | lower heating value |

As used herein "wellpads" is defined as a relatively flat work area on the earth surface, and is used for well-drilling and oil production.

The present invention provides a method of recovering heat from hot produced fluids at SAGD facilities that utilize wellpad steam generation such as Direct Steam Generators. In a broad sense, the heated fluids produced by SAGD are used to preheat the water that is used to make steam for SAGD. Thus, less energy is needed and the cost effectiveness of the process is increased.

In one aspect of the present invention, a system for improving heat recovery in wellpad SAGD steam generation is provided. The system comprises more than one wellpads on which different equipment are installed for the production of oil. The system also comprises pad separators located on wellpads for separating gases from emulsion from the produced fluids, and each pad separator has an inlet, a gas outlet and an emulsion outlet, wherein the produced fluids enter the pad separators through the inlet, and the separated produced gases exit the pad separators through the gas outlet, and the separated produced emulsion exits the pad separator through the emulsion outlet. In addition, the system comprises a wellpad heat exchanger located on the wellpad, wherein a feedwater is preheated at the wellpad heat exchanger by the produced fluids, the separated produced emulsion, or the separated produced gases. The heat exchanger could also be placed in the production well to enable heat exchange with hot fluids before they reach the surface.

In another embodiment, the feedwater is further preheated at the CPF by the separated produced emulsion before heated by the wellpad heat exchanger at the wellpad, such that even more energy can be saved in heating the feedwater.

In another embodiment, the invention is a system and method for more cost effective SAGD hydrocarbon recovery, comprising a heavy oil or bitumen reservoir, which produces heated hydrocarbon fluids by SAGD based processes. The system includes wellpads over said reservoir, wherein said wellpads include wellpad steam generator and a heat exchanger, such that heated fluids produced by SAGD recovery are used to preheat the water for the direct steam generator. Because everything is located onsite, heat losses are minimized and efficiencies maximized.

In additional embodiments, there are also pad separators located on the wellpads, each of the pad separators having an inlet, a gas outlet and an emulsion outlet, so that heated hydrocarbon fluids enter the pad separators through the inlet and are separated into gases and a heated emulsion, wherein the gases exit the pad separators through the gas outlet, and the heated emulsion exits the pad separator through the emulsion outlet and passes to said wellpad heat exchanger; and wherein a wellpad steam generator feedwater is preheated at the wellpad heat exchanger by said heated hydrocarbon fluids, said heated emulsion, or said produced gases in said wellpad heat exchanger.

DESCRIPTION OF EMBODIMENTS OF THE INVENTION

The present invention is exemplified with respect to installation and configuration of heat exchanger on wellpads for SAGD production process, so as to recover heat from produced fluids at SAGD wellpads to preheat feedwater for wellpad steam generation. However, this is exemplary only, and the invention can be broadly applied to all steam-related oil production processes, such as Cyclic Steam Stimulation.

The invention provides a novel method of recovering heat from hot produced fluids at SAGD facilities that utilize wellpad steam generation such as Direct Steam Generators. The invention is based on the idea of preheating the feedwater by exchanging heat with produced fluids at the wellpads, rather than at the SAGD central processing facility (CPF).

Current SAGD facilities deliver steam from the CPF to the wellpads for reservoir injection. The temperature of this steam (~300° C.) is considerably higher than the produced fluid temperatures (180-200° C.), so heat recovery from these fluids is not possible.

However, with the use of DSGs located at the wellpads, where feedwater is conveniently preheated at the wellpads by the produced emulsion/gases before feeding to the DSGs, energy conservation is achieved. Because wellpad heat recovery minimizes heat losses to the environment, it enables higher feedwater preheat temperatures, which reduces the steam generation fuel and oxidant requirements. This can lower the cost of conducting wellpad steam generation at SAGD facilities.

The present invention takes advantage of the fact that feedwater for wellpad steam generators can be preheated by hot produced fluids at the wellpads themselves. The concept is illustrated in FIGS. 1*a* and 1*b*, which show simplified flowsheets of DSG-based SAGD processes.

Figure 1A:
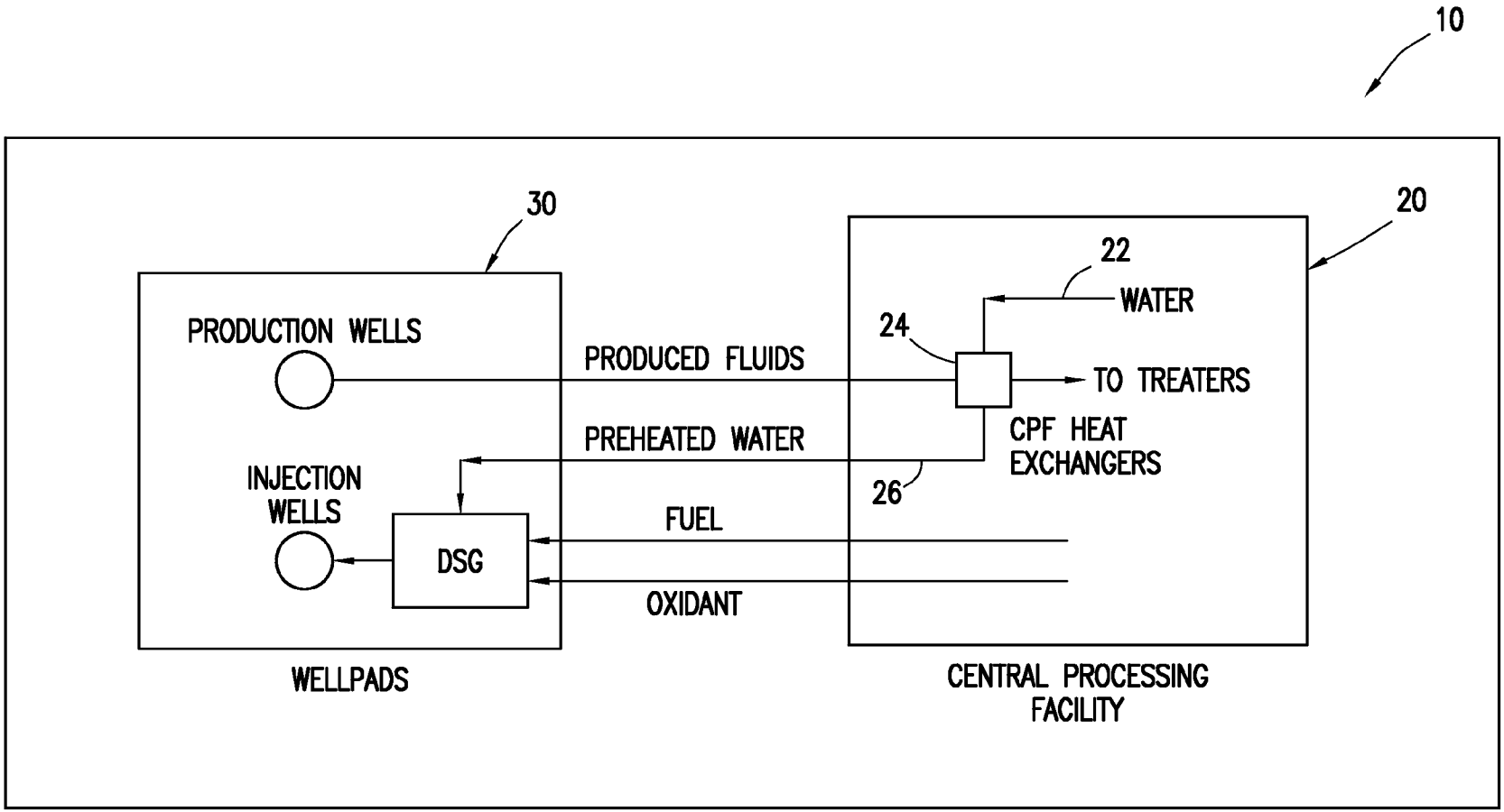
FIG. 1*a* is a simplified schematic view of a convention DSG-based SAGD process with heat recovery at Central Processing Facility.

FIG. 1*a* shows a conventional heat recovery process where the hot produced fluids arriving at the CPF 20 are used to preheat DSG feedwater 22 in one or more heat exchangers 24, and the heated feedwater 26 is sent to the wellpads 30. It should be noted that in this approach, heat is lost to the environment from the produced fluids as they travel to the CPF 20 as well as from the preheated water 26 as it travels to the wellpads. The effect is to reduce the temperature of the feedwater 26 when it arrives at the DSGs 30, thus increasing energy requirements and cost.

Figure 1B:
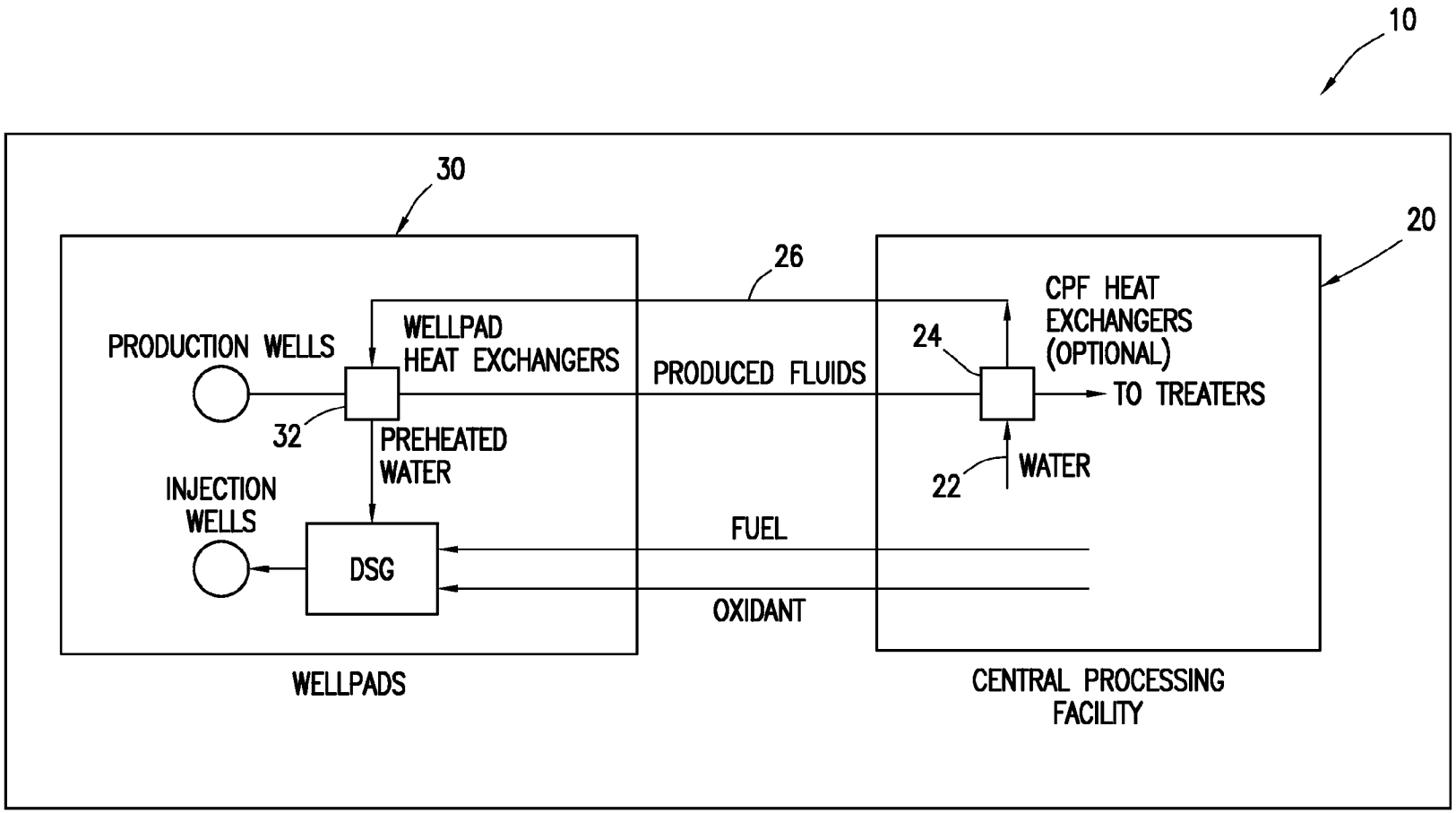
FIG. 1*b* is a simplified schematic view of a DSG-based SAGD process with heat recovery at wellpads according to the present invention.

FIG. 1*b* shows the novel method where the feedwater 26 is preheated 32 at the wellpads 30, with optional preheating at the CPF 20 in one or more heat exchangers 24. The main benefit of this approach is the fact that a higher feedwater 22 preheat temperature can be attained since heat losses to the environment are minimized. The higher feedwater temperature increases the steam generating efficiency of the wellpad 30 steam generators because less fuel energy is required to convert the higher enthalpy water into steam.

The following examples are illustrative only, and are not intended to unduly limit the scope of the invention.

EXAMPLE 1

Heating Feedwater by Produced Emulsion at Wellpad

An AspenPlus® process model (a process modeling tool supplied by Aspen Technology, Inc.) was used to quantify the benefits of wellpad versus CPF heat recovery. Specifically, the model was used to determine the feedwater preheat temperatures that can be attained for DSG-based SAGD operations.

Figure 2A:
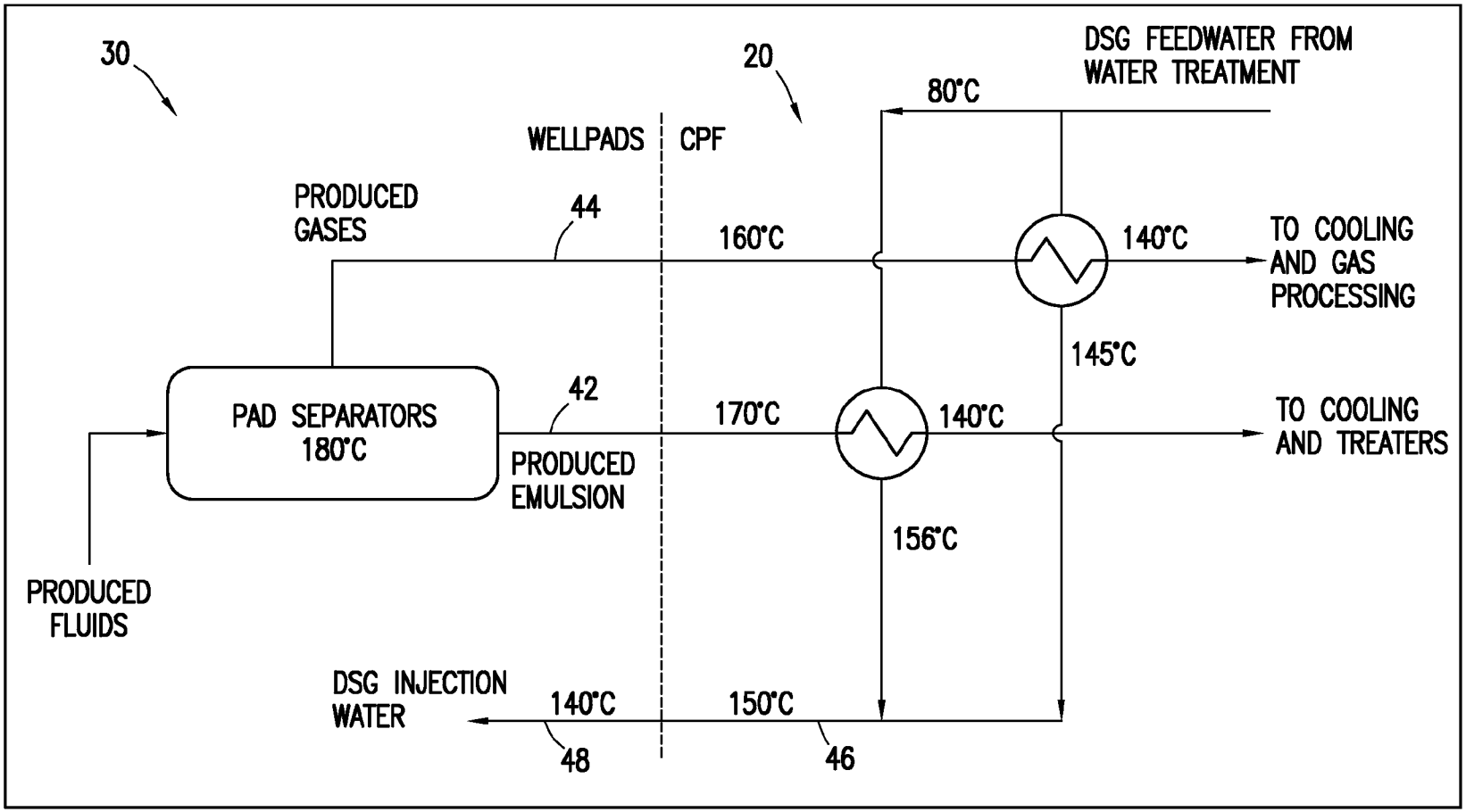
FIG. 2*a* is a schematic view showing temperatures of fluids and gases in a conventional DSG-based SAGD process with heat recovery at CPF.

FIG. 2*a* shows the CPF heat recovery case where produced fluids at the wellpads 30 are conveyed to the CPF 20 in two separate lines, one containing bitumen/water emulsion 42, and one containing produced gases 44. As shown in the figure, this will enable a DSG water preheat temperature of 150° C. 46 at the CPF, which drops to 140° C. 48 at the wellpads assuming a 10° C. temperature drop in the water lines due to ambient heat losses.

Figure 2B:
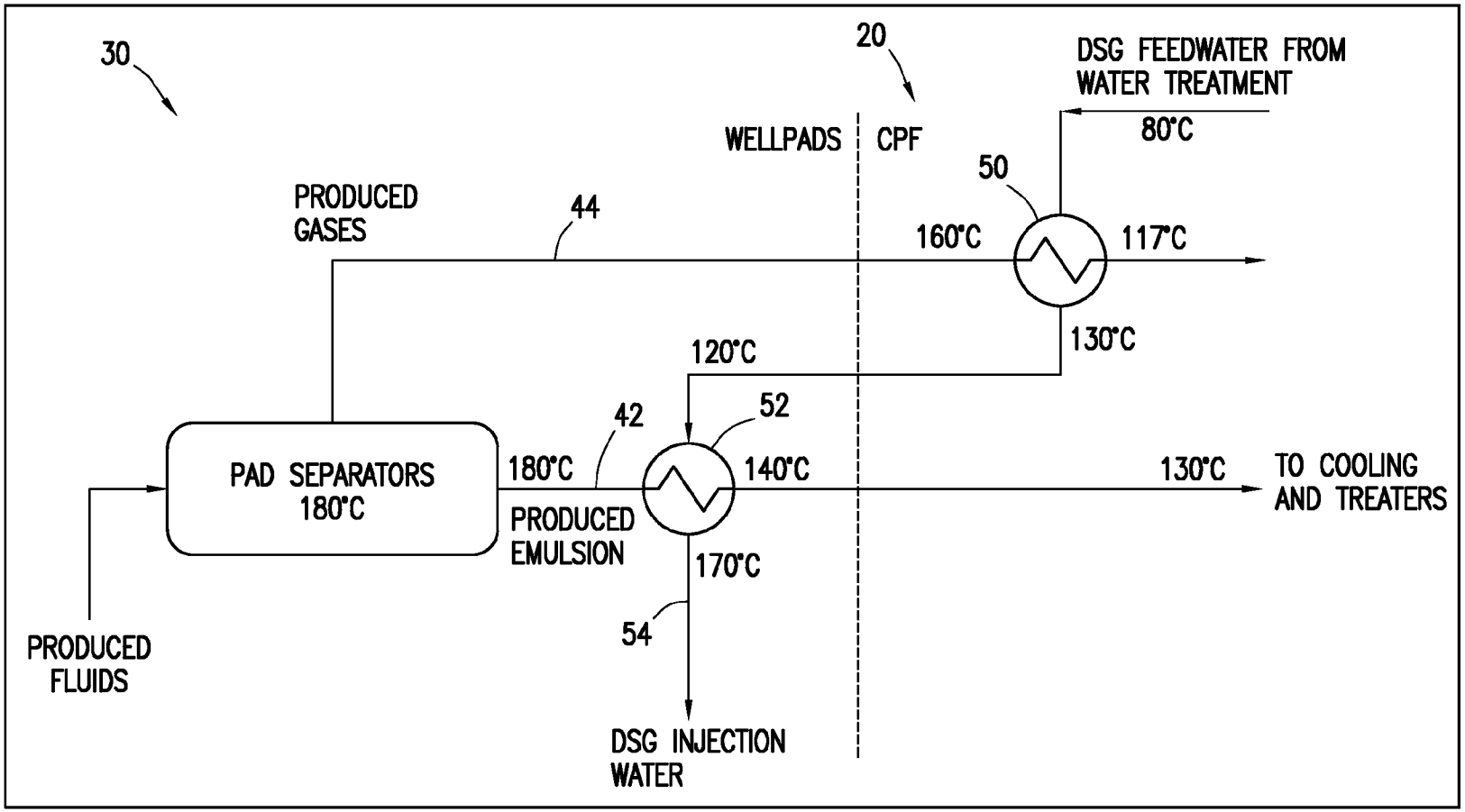
FIG. 2*b* is a schematic view showing temperatures of fluids and gases in a DSG-based SAGD process with heat recovery at wellpads according to the present invention.

The wellpad heat recovery case shown in FIG. 2*b* was based on heat exchange with the produced water/bitumen emulsion 42 at the wellpads 30 and heat exchange 50 with produced gases 44 at the CPF 20. This was considered a preferred configuration because the more compact liquid-liquid exchangers 52 will minimize the equipment footprint at each wellpad. As shown in the figure, this approach will enable a DSG water 54 preheat temperature of 170° C., which is 30° C. higher than the CPF heat recovery case.

The key benefit of the higher preheat temperature is a reduction in the amount of fuel and oxidant needed to produce a given quantity of SAGD steam. Specifically, the 30° C. higher preheat temperature will reduce the specific DSG fuel usage from 364 to 346 SCF natural gas per bbl steam, while the oxygen consumption will fall by a corresponding amount. The reduced fuel and oxygen usage will translate into lower operational expenses (OPEX) as well as lower capital expenses (CAPEX) due to the reduced size of the air separation unit.

The key assumption in this assessment was the 10° C. temperature drop in all lines that convey hot fluids between the wellpads and the CPF. If the actual heat losses are greater, which may be the case during the winter months, the benefits provided by wellpad heating will be more significant because for every additional 10° C. temperature drop in the lines conveying hot fluids between the wellpads and the CPF, the energy saved by using the present invention is doubled.

In this example, the following parameters are assumed: 900 Btu/SCF natural gas (LHV basis), DSG steam/$CO_2$ produced at 60 bar(a) and 283° C., fuel and oxygen delivered to DSG at 10° C., and 2% DSG heat losses.

EXAMPLE 2

Heating Feedwater by Produced Fluids at Wellpad

The configuration of this example is similar to Example 1 as shown in FIG. 2*b*, except that the heat exchange takes place between the feedwater and the produced fluids before the produced fluids enter the pad separators. One benefit of such configuration is that even more heat can be recovered from the produced fluids, because some enthalpies may be lost during the separation in the pad separators.

EXAMPLE 3

Heating Feedwater by Produced Gases at Wellpad

The configuration of this example is similar to Example 1 as shown in FIG. 2*b*, except that the heat exchange takes place between the feedwater and the produced gases instead of the produced emulsions.

EXAMPLE 4

Heating Feedwater by Produced Fluids within Production Well

The configuration of this example is similar to Example 1 as shown in FIG. 2*b*, except that an additional heat exchange takes place within the wellbore through an additional exchanger located inside the wellbore (not shown).

The novel feature of the invention is the fact that some feedwater preheating occurs at the SAGD wellpads and not at the central processing facility. This maximizes the attainable preheat temperature and reduces the fuel and oxidant required by the wellpad steam generators. We have tested this theory using the process modeling and shown that for every additional 10° C. temperature drop in the lines conveying hot fluids between the wellpads and the CPF, the energy saved by using the present invention is doubled.

What is claimed is:

1. A system for recovering heat in wellpad Steam Assisted Gravity Drainage (SAGD) steam generation, comprising:

wellpads;

at least one steam generator located at or near the wellpads, wherein feedwater is supplied to the steam generator;

a produced fluids line conveying produced fluids from the well pad to pad separators, the pad separators located on the wellpads, each of the pad separators having an inlet, a gas outlet, and an emulsion outlet, wherein the produced fluids enter the pad separators through the inlet, and separated produced gases exit the pad separators through the gas outlet, and separated produced emulsion exits the pad separator through the emulsion outlet;

a produced gas line conveying produced gases from the pad separator gas outlet, a produced emulsion line conveying produced emulsion from the pad separator emulsion outlet, and a wellpad heat exchanger located on the wellpads connected to one or more lines on the wellpad wherein produced fluids, produced gases, or produced emulsion provide heat for the wellpad heat exchanger and wherein the feedwater is preheated at the wellpad heat exchanger by the produced fluids before the produced fluids enter the pad separators.

2. The system of claim 1, wherein the feedwater is previously preheated at a Central Processing Facility heat exchanger.

3. A method of improving heat recovery at a wellpad Steam Assisted Gravity Drainage (SAGD) for hydrocarbon production, the wellpad SAGD having at least one steam generator located at or near the wellpad, wherein feedwater is supplied to the steam generator; pad separators located on the wellpad, each of the pad separators having an inlet, a gas outlet and an emulsion outlet, wherein produced fluids enter the pad separators from a produced fluids line through the inlet, and separated produced gases exit the pad separators from the gas outlet through a produced gas line, and separated produced emulsion exits the pad separator from the emulsion outlet through a produced emulsion line; and a wellpad heat exchanger located on the wellpad, the method comprising:

preheating the feedwater at the wellpad through a wellpad heat exchanger before the feedwater enters the steam generator, wherein the feedwater is preheated at the wellpad by the produced fluids before the produced fluids enter the pad separators; and generating steam by the steam generator using the preheated feedwater.

4. The method of claim 3, further comprising, before the preheating step, the step of preheating the feedwater at a Central Processing Facility.

* * * * *